US006624587B2

(12) United States Patent
Kim

(10) Patent No.: US 6,624,587 B2
(45) Date of Patent: Sep. 23, 2003

(54) METHOD AND APPARATUS FOR DRIVING PLASMA DISPLAY PANEL

(75) Inventor: Won Tae Kim, Kumi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/151,930

(22) Filed: May 22, 2002

(65) Prior Publication Data

US 2002/0175631 A1 Nov. 28, 2002

(30) Foreign Application Priority Data

May 23, 2001 (KR) ..... P2001-28454
May 23, 2001 (KR) ..... P2001-28455

(51) Int. Cl.[7] ..... G09G 3/10
(52) U.S. Cl. ..... 315/169.1; 315/169.4; 345/60; 345/63
(58) Field of Search ..... 315/169.1–169.4; 345/60, 63, 67, 68, 55; 313/582, 584, 585; 445/24

(56) References Cited

U.S. PATENT DOCUMENTS 6,242,860 B1 * 6/2001 Sasao et al. ..... 313/586
6,285,128 B1 * 9/2001 Amemiya ..... 313/582
6,344,713 B1 * 2/2002 Awaji et al. ..... 313/582
6,384,802 B1 * 5/2002 Moon ..... 345/60

FOREIGN PATENT DOCUMENTS

JP 10064432 A * 3/1998 ..... H01J/11/02
JP 10064434 A * 3/1998 ..... H01J/11/02
JP 10069858 A * 3/1998 ..... H01J/11/00

* cited by examiner

*Primary Examiner*—Haissa Philogene
(74) *Attorney, Agent, or Firm*—Fleshner & Kim, LLP

(57) ABSTRACT

A method of driving a plasma display panel and an apparatus thereof that is capable of preventing an abnormal discharge generated at the upper and lower edges of an effective display area of the plasma display panel. In the method and apparatus, a voltage having a mutually contrary polarity is applied to two electrodes opposed to each other with having a space discharge therebetween within an effective display area to select a cell. A constant voltage is applied to a dummy electrode arranged at the outside of the effective display area during an address period for selecting said cell.

21 Claims, 11 Drawing Sheets

METHOD AND APPARATUS FOR DRIVING PLASMA DISPLAY PANEL

BACKGROUND OF THE INVENTION

1. Field of the Invention

This invention relates to a driving technique for a plasma display panel, and more particularly to a method of driving a plasma display panel and an apparatus thereof that is capable of preventing an abnormal discharge generated at the upper and lower edges of an effective display area of the plasma display panel.

2. Description of the Related Art

Generally, a plasma display panel (PDP) radiates a phosphor using an ultraviolet with a wavelength of 147 nm generated upon discharge of an inactive mixture gas such as He+Xe, Ne+Xe or He+Ne+Xe, to thereby display a picture including characters and graphics. Such a PDP is easy to be made into a thin-film and large-dimension type. Moreover, the PDP provides a very improved picture quality owing to a recent technical development. Particularly, since a three-electrode, alternating current (AC) surface-discharge PDP has wall charges accumulated in the surface thereof upon discharge and protects electrodes from a sputtering generated by the discharge, it has advantages of a low-voltage driving and a long life.

Referring to FIG. 1, a discharge cell of a conventional three-electrode, AC surface-discharge PDP includes a scan/sustain electrode 12Y and a common sustain electrode 12Z provided on an upper substrate 11, and an address electrode 17X provided on a lower substrate 16.

The scan/sustain electrode 12Y and the common sustain electrode 12Z are formed from a transparent electrode material, such as indium-tin-oxide (ITO). Each of the scan/sustain electrode 12 and the common sustain electrode 12Z is provided with a metal bus electrode 13 for reducing a resistance.

An upper dielectric layer 14 and a protective film 15 are disposed on the upper substrate 11 provided with the scan/sustain electrode 12Y and the common sustain electrode 12Z. The protective film 15 prevents a damage of the upper dielectric layer 14 caused by a sputtering during the plasma discharge and improves the emission efficiency of secondary electrons. This protective film 15 is usually made from magnesium oxide (MgO).

A lower dielectric layer 18 and barrier ribs 19 are formed on the lower substrate 18 provided with the address electrode 17X. The surfaces of the lower dielectric layer 18 and the barrier ribs 19 are coated with a fluorescent material layer 20. The address electrode 17X is formed in a direction crossing the scan/sustain electrode 12Y and the common sustain electrode 13Z.

The barrier ribs 19 is formed in a direction parallel to the address electrode 17X to prevent an ultraviolet ray and a visible light generated by the discharge from being leaked to the adjacent discharge cells. The fluorescent material layer 20 is excited by an ultraviolet ray generated upon plasma discharge to produce any one of red, green and blue visible lights. An inactive mixture gas such as He+Xe or Ne+Xe is injected into a discharge space defined between the upper and lower substrate 11 and 16 and the barrier rib 19.

FIG. 2 shows a schematic electrode arrangement of the conventional three-electrode, AC surface-discharge PDP.

Referring to FIG. 2, the conventional three-electrode, AC surface-discharge PDP includes a scan electrode 12Y and a sustain electrode 12Z formed in a parallel to each other, and an address electrode 17X perpendicular to the scan electrode 12Y and the sustain electrode 12Y. A discharge cell 30 is provided at each intersection among the address electrode 17X and a pair of scan electrode 12Y and sustain electrode 12Z. Non-effective display areas 32 and 33 positioned at the outer sides of the upper and lower edges of an effective display area of the PDP are provided with dummy electrodes D. In other words, the dummy electrodes D of the upper non-effective display area 32 are provided at the upper portion of the first scan electrode Y1 positioned at the uppermost portion of the effective display area 31 while the dummy electrodes D of the lower non-effective display area 33 are provided at the lower portion of the nth sustain electrode Z positioned at the lowermost portion of the effective display area 31. The dummy electrodes D play a role to cause a priming discharge so that it can supply priming charged particles to the uppermost line and the lowermost line of the effective display area 31.

In order to realize gray levels of a picture, such a PDP is driven by dividing one frame into various sub-fields having a different discharge frequency. Each sub-field is again divided into a reset period for causing a uniform discharge, an address period for selecting a discharge cell and a sustain period for implementing gray levels depending upon a discharge frequency. For instance, when it is intended to display a picture of 256 gray levels, a frame interval equal to 1/60 second (i.e. 16.67 ms) is divided into 8 sub-fields as shown in FIG. 3. Each of the 8 sub-fields is again divided into an address period and a sustain period. Herein, the reset period and the address period of each sub-field are equal every sub-field, whereas the sustain interval and the discharge frequency become different depending upon a brightness weighting value assigned to each sub-field. If a brightness weighting value is increased at a ratio of $2^n$ (wherein n=0, 1, 2, 3, 4, 5, 6 and 7) for each successive sub-field, then each of the sustain period and the discharge frequency is twice increased in proportion to said brightness weighting value $2^n$ whenever the current sub-field is transited into the next sub-field. Gray levels of a picture supplied in one frame interval can be implemented by a combination of the sustain discharge frequency differentiated for each sub-field as mentioned above.

However, the conventional PDP has a problem in that an abnormal discharge is caused by electric charges excessively accumulated at the non-effective display areas 32 and 33 positioned at the outer sides of the uppermost and lowermost portions of the effective display area 31. If such a normal discharge is generated, then a light accompanied by the discharge is diffused into the effective display area 31. Thus, a display quality is deteriorated. Furthermore, a picture fails to be displayed for several seconds and the discharge cell may be damaged in a serious circumstance. The abnormal discharge becomes more serious as a brightness of the PDP goes higher and a resolution of the PDP goes higher.

In order to overcome such an abnormal discharge, Japanese Laid-open Patent Gazette No. Pyung 10-64432 has been suggested a method of removing dielectric materials of the upper and lower edges of the PDP to discharge electric charges accumulated in the non-effective display areas 32 and 33 through the address electrode 17X. Also, Japanese Laid-open Patent Gazette No. Pyung 10-69858 has been suggested a method of providing a normal turn-on area at the upper and lower edges of the PDP to cause a discharge at the normal turn-on area, thereby eliminating electric charges. However, these methods have a problem in that they are effective only when the entire area of the PDP is used as the effective display area, but fails to prevent the abnormal discharge in a case when a portion of the PDP is used as the display area.

Otherwise, Japanese Laid-open Patent Gazette No. Pyung 10-64434 has been suggested a method of mixing conductive particles within a dielectric layer provided with an address electrode to discharge electric charges accumulated in the upper and lower edges of the effective display area by utilizing the dielectric layer. This method has a problem in that it has a difficulty in keeping an electric conductivity of the dielectric layer in the baking process.

SUMMARY OF THE INVENTION

Accordingly, it is an object of the present invention to provide a method of driving a plasma display panel and an apparatus thereof that is capable of preventing an abnormal discharge generated at the upper and lower edges of an effective display area of the plasma display panel.

In order to achieve these and other objects of the invention, a method of driving a plasma display panel according to one aspect of the present invention includes the steps of applying a voltage with potential difference enabling discharge to two electrodes opposed to each other with having a space discharge therebetween within an effective display area to select a cell; and applying a constant voltage to a dummy electrode arranged at the outside of the effective display area during an address period for selecting said cell.

The method further includes the step of applying a reset voltage to a scan electrode, which is any one of said two electrodes, prior to selecting said cell to initialize cells of the entire field.

The method further includes the step of synchronizing a voltage having the same polarity as the reset voltage and a lower voltage level than the reset voltage to apply it to an address electrode of said two electrodes.

A method of driving a plasma display panel according to another aspect of the present invention includes the steps of arranging a scan electrode supplied with a scan voltage at the uppermost and lowermost portion of an effective display area and applying a voltage with potential difference enabling discharge to an address electrode crossing the scan electrode and said scan electrode, thereby selecting a cell; and alternately applying a sustain voltage to a sustain electrode making a pair with the scan electrode and said scan electrode to cause a sustain discharge for the selected cell.

In the method, said sustain electrode is arranged successively at at least one portion thereof.

The method further includes the step of arranging a dummy electrode within a non-effective display area being adjacent to the scan electrodes at the uppermost and lowermost portions thereof.

In the method, said voltage applied to the dummy electrode is a negative voltage.

Said address electrodes are divided and said scan electrodes are arranged in such a manner to be adjacent to each other at the divided areas.

A driving apparatus for a plasma display panel according to still another aspect of the present invention includes a driver for applying a voltage with potential difference enabling discharge to two electrodes opposed to each other with having a space discharge therebetween within an effective display area to select a cell between the two electrodes; and a dummy electrode driver for applying a constant voltage to a dummy electrode arranged at the outside of the effective display area during an address period for selecting said cell.

In the driving apparatus, the dummy electrode driver applies a positive voltage to the dummy electrode.

Otherwise, the dummy electrode driver applies a negative voltage to the dummy electrode.

Said driver includes a scan driver for applying a reset voltage, a scan voltage and a sustain voltage to the scan electrode; and an address driver for applying a data voltage synchronized with said scan voltage to the address electrode opposed to the scan electrode with having a discharge space therebetween.

The address driver synchronizes a voltage having the same polarity as said reset voltage and a lower voltage level than said reset voltage with said reset voltage to apply it to the address electrode.

The driving apparatus further includes a sustain driver for applying a sustain voltage to a sustain electrode making a pair with the scan electrode.

A driving apparatus for a plasma display panel according to still another aspect of the present invention includes a first driver for applying a voltage with potential difference enabling discharge to scan electrodes arranged at the uppermost and lowermost portions of an effective display area and an address electrode crossing the scan electrodes to select a cell; and a second driver for alternately applying a sustain voltage to a sustain electrode making a pair with the scan electrode and said scan electrode to cause a sustain discharge for the selected cell.

In the driving apparatus, said sustain electrode is arranged successively at at least one portion thereof.

The driving apparatus further includes a dummy electrode arranged within a non-effective display area being adjacent to the scan electrodes at the uppermost and lowermost portions thereof.

The driving apparatus further includes a dummy driver for applying a negative voltage to the dummy electrode.

Said address electrodes are divided and said scan electrodes are arranged in such a manner to be adjacent to each other at the divided areas.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 4:
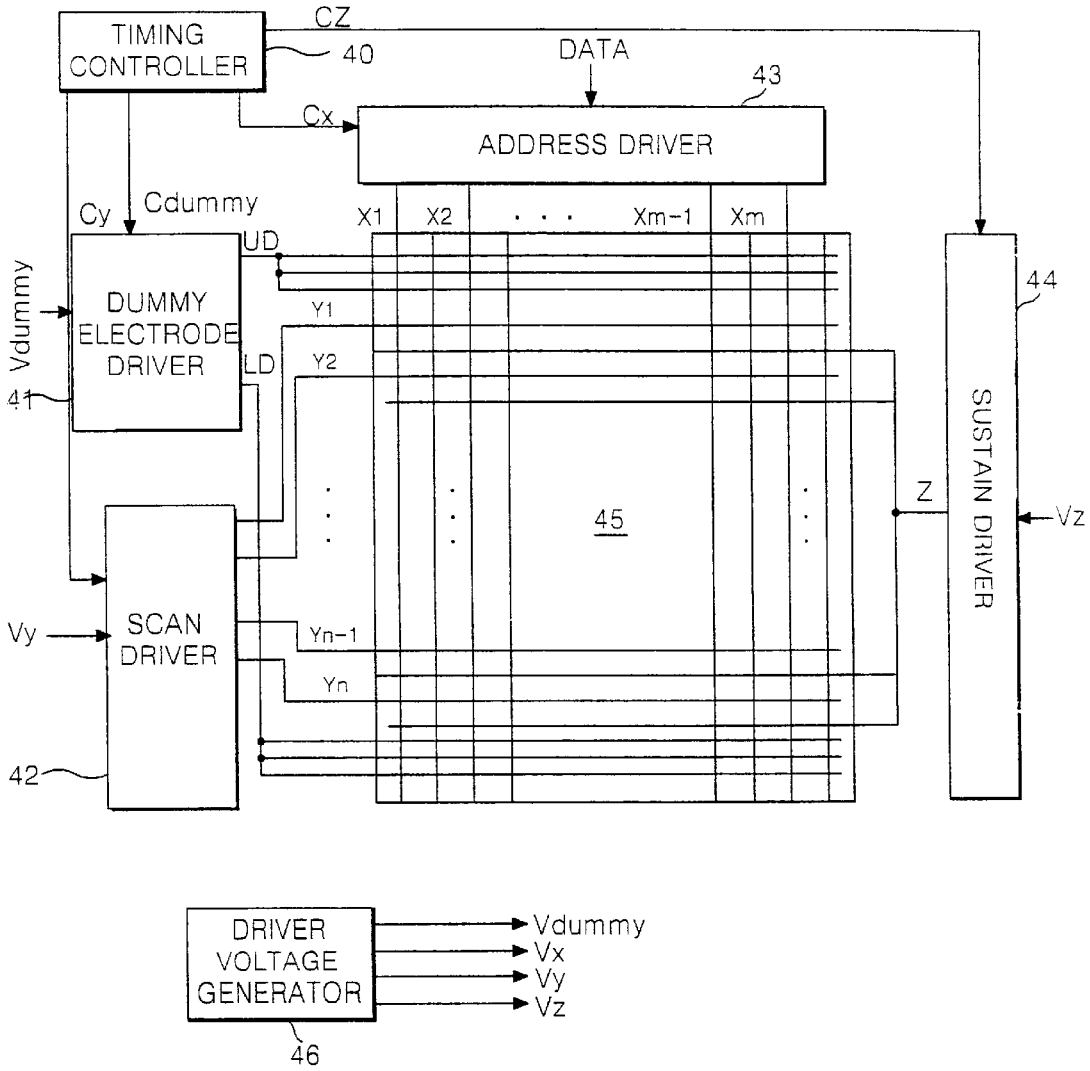
FIG. 4 is a block diagram of a driving apparatus for a PDP according to an embodiment of the present invention.

Referring to FIG. 4, a driving apparatus for a plasma display panel (PDP) according to an embodiment of the present invention includes an address driver 43 for supplying a data to address electrodes X1 to Xm of the PDP 45, a scan driver 42 for supplying a driving voltage Vy required for scan electrodes Y1 to Yn of the PDP 45, a dummy electrode driver 41 for applying a dummy electrode Vdummy for confining unnecessary electric charges existing in the upper and lower edges of the effective display area of the PDP 45 to dummy electrodes UD and LD of the PDP 45, a timing controller 40 for controlling each electrode driver 41 to 44, and a driving voltage generator 46 for generating driving voltages Vx, Vy, Vz and Vdummy.

The address driver 43 simultaneously supplies a data mapped for each sub-field by means of a sub-field mapping circuit to the address electrodes X1 to Xm under control of the timing controller 40 after making an inverse gamma correction and an error diffusion by means of an inverse gamma correcting circuit and an error diffusion circuit, etc. (not shown). Herein, the data voltage Vx is applied to address electrodes X1 to Xm selected in accordance with a logical value of a data inputted to the address driver 43.

The scan driver 42 applies different voltages Vy to the scan electrodes in the reset period, the address period and the sustain period under control of the timing controller 40. The driving voltage Vy of the scan electrode is divided into a reset voltage, a scan voltage and a sustain voltage. The scan driver 42 applies a reset voltage having a relatively high voltage level in the reset period to the scan electrodes Y1 to Ym. The scan driver 42 sequentially applies a scanning pulse a scan line, at which an addressing of the cell is made during the address period, to the scan electrodes Y1 to Ym. The scan driver 42 simultaneously applies a sustain pulse for causing a sustain discharge, that is, a display discharge of the cell selected in the sustain period to the scan electrodes Y1 to Ym. Herein, a frequency of the sustain pulse is determined in accordance with a brightness weighting value assigned to each sub-field.

The sustain driver 44 applies a direct current voltage to the sustain electrodes Z during the address period under control of the timing controller and thereafter applies the sustain pulse to the sustain electrodes Z in the sustain period.

The dummy electrode driver 41 applies a positive or negative voltage for confining electric charges moved into the non-effective display area positioned at the upper and lower outsides of the effective display area to the dummy electrodes UD and LD in the address period. The timing controller 40 receives a vertical/horizontal synchronizing signal to generate timing control signals Cx, Cy, Cz and Cdummy required for each electrode driver 41 to 44, and applies the timing control signals Cx, Cy, Cz and Cdummy to the corresponding drivers 41 to 44.

Figure 5:
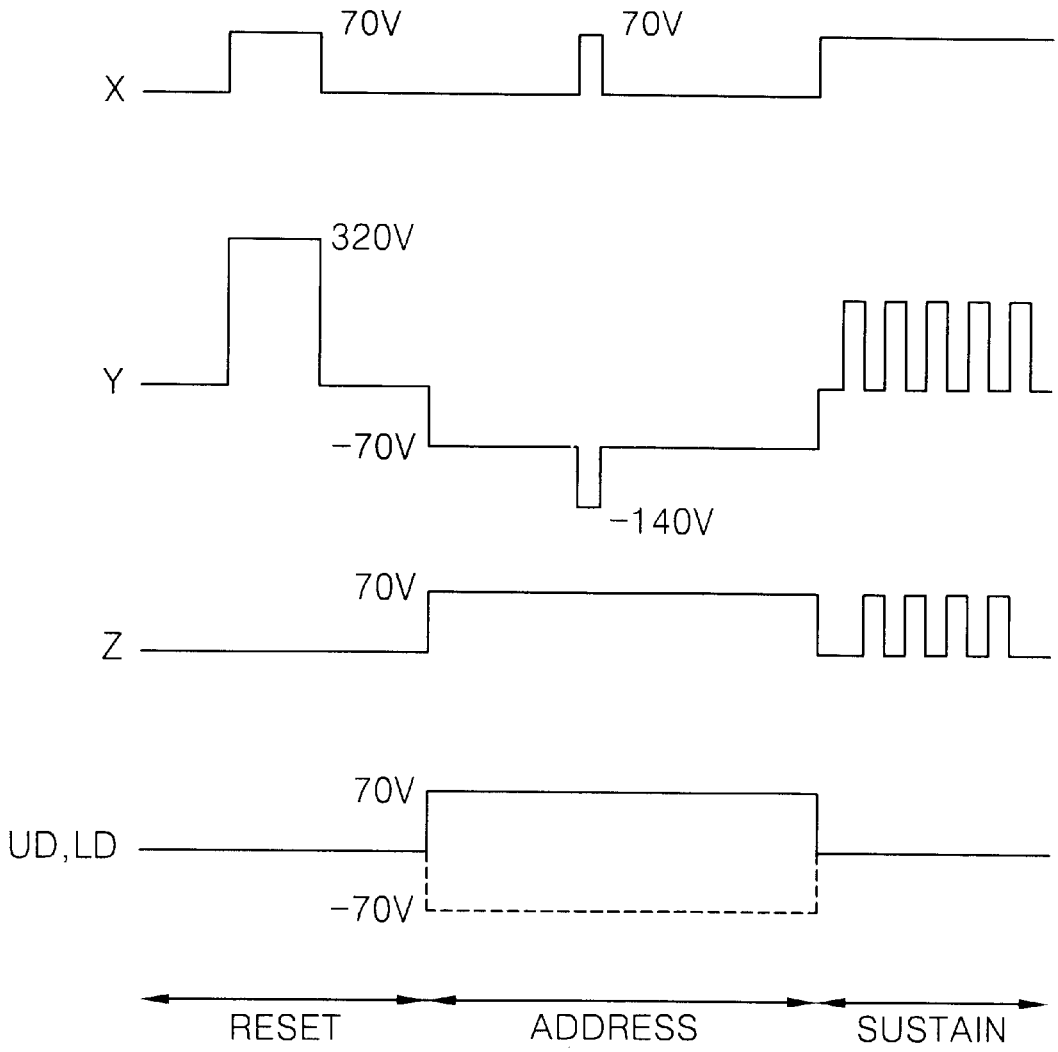
FIG. 5 is a waveform diagram of signals outputted from the PDP driving apparatus shown in FIG. 4.

FIG. 5 shows a voltage generated from each driver 41 to 44 in FIG. 4.

Referring to FIG. 5, the PDP according to the embodiment of the present invention divides one frame into a reset period for initializing a discharge condition of the PDP 45, an address period for selecting a cell and a sustain period for causing a display discharge of the selected cell for its driving.

In the reset period, a voltage of about 70V is applied to the address electrode X and a voltage of about 320V is applied to all the scan electrodes Y. At this time, all the discharge cells of the PDP 45 cause a discharge between negative wall charges stacked on the scan electrode Y and positive wall charges stacked on the sustain electrode Z to make a self-erase discharge. This self-erase discharge uniforms a quantity of wall charges accumulated in all the discharge cells of the PDP 45.

In the address period, a negative scan pulse of about −140V is sequentially applied to the scan electrodes Y and, at the same time, a positive data pulse of about 70V is applied to the address electrodes X. At this time, within the cell coupled with the data pulse, a potential difference between the negative scan voltage and the positive data voltage is added to a wall voltage generated in the initialization period to cause a discharge, that is, an address discharge. In the address period, a positive direct current voltage of approximately more than 70V is applied to the sustain electrode Z so that an address discharge can mainly occur between the scan electrode Y and the address electrode X. Also, in the address period, a negative direct current voltage of approximately more than −70V is applied to the upper dummy electrodes UD and, at the same time, a positive direct current voltage of approximately more than 70V is applied to the lower dummy electrodes LD. The direct current voltages applied to the dummy electrodes UD and LD allows charged particles generated the upper and lower outsides of the effective display area or moved from the effective display area into the upper and lower outsides to be confined. This will be described in detail in conjunction with FIG. 6A and FIG. 6B later.

In the sustain period, a sustain pulse is alternately applied to the scan electrodes Y and the sustain electrodes Z. Then, at the cells selected by the address discharge, the wall voltage within the cells is added to the sustain pulse to cause a discharge, that is, a sustain discharge or a display discharge between the scan electrode Y and the sustain electrode Z whenever each sustain pulse is applied thereto.

Figure 6A:
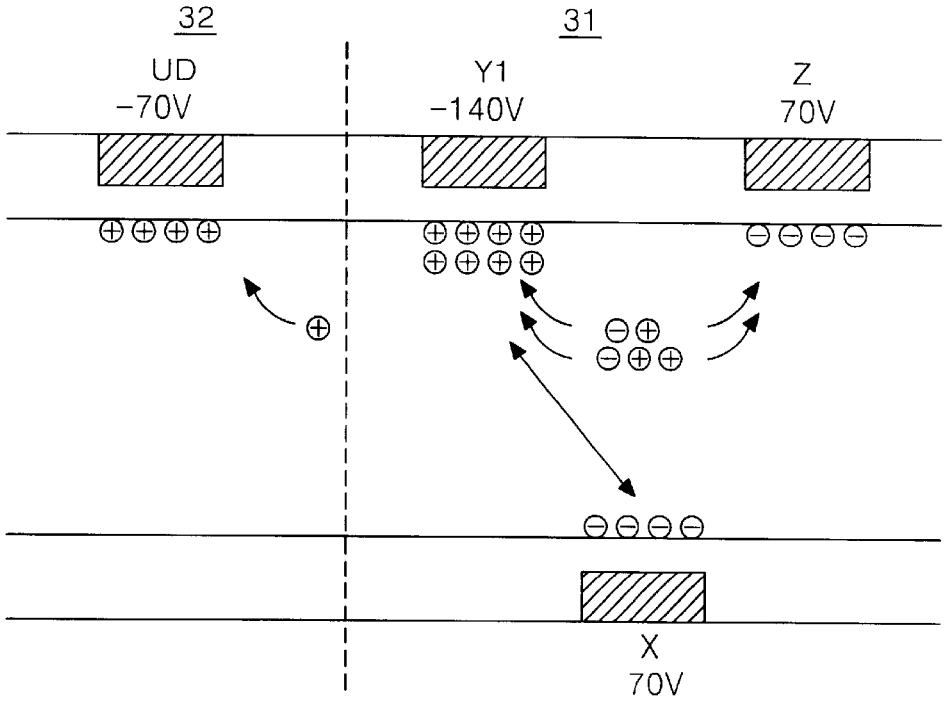
FIG. 6A depicts a movement of charged particles at a boundary portion between an upper non-effective display area and an effective display area when a positive direct current voltage is applied to the upper dummy electrodes shown in FIG. 4.
Figure 6B:
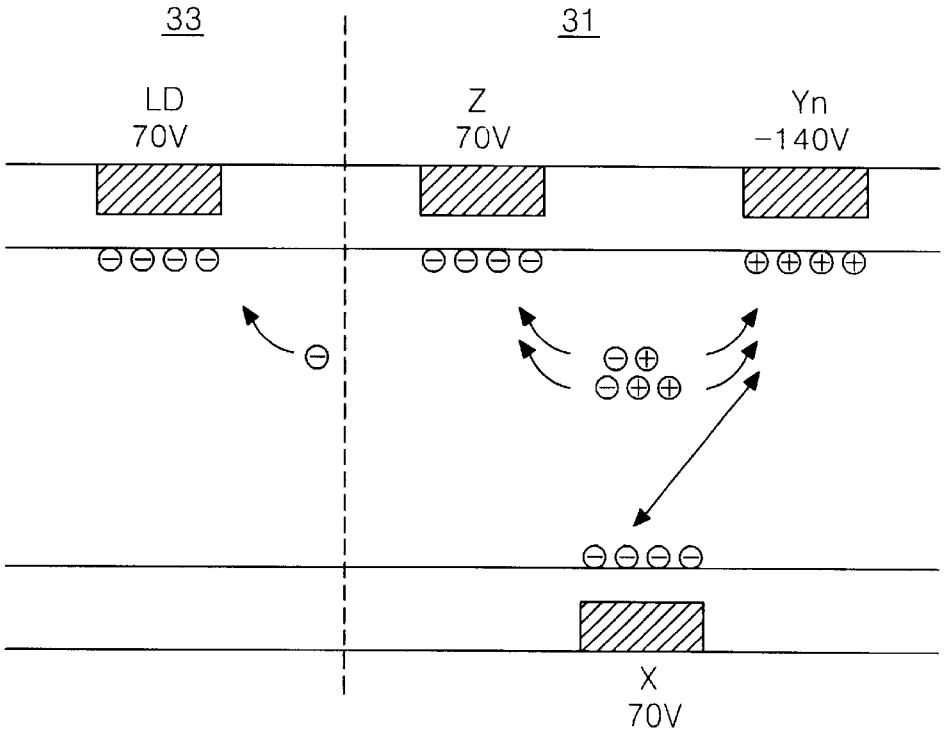
FIG. 6B depicts a movement of charged particles at a boundary portion between an upper non-effective display area and an effective display area when a positive direct current voltage is applied to the lower dummy electrodes shown in FIG. 4.

FIG. 6A and FIG. 6B shows a movement of charged particles at the boundaries between the non-effective display areas 32 and 33 and the effective display area 31 when a positive direct current voltage is applied to the dummy electrodes UD and LD.

Referring to FIG. 6A, the dummy electrode UD provided at the non-effective display area 32 at the upper portion is adjacent to the uppermost scan electrode Y1 of the effective display area 31.

If a negative scan voltage of about −140V is applied to the uppermost scan electrode Y1 and, at the same time, a positive data voltage of about 70V is applied to the address electrode X at an initial time of the address period, then an address discharge occurs. This address discharge allows positive and negative electric charges to be generated within a discharge space. The negative electric charges are stacked on the address electrode X and the sustain electrode Z. A majority of positive electric charges are stacked on the scan electrode Y1 while a portion of positive space electric charges are moved into the upper non-effective display area 32. At this time, if a negative voltage is applied to the upper dummy electrodes UD, then positive electric charges moved into the upper non-effective display area 32 are stacked on the upper dummy electrodes UD. As a result, since positive wall charges are stacked on the upper dummy electrode UD and the uppermost scan electrode Y1 of the effective display area 31, an abnormal discharge is not generated between the two electrodes UD and Y1.

Referring to FIG. 6B, the dummy electrode LD provided at the lower non-effective display area is adjacent to the lowermost sustain electrode Z of the effective display area 31.

If a negative scan voltage of about −140V is applied to the lowermost scan electrode Yn of the effective display area 31 and, at the same time, a positive data voltage of about 70V is applied to the address electrode X about the time when the address period is terminated, then an address discharge occurs. This address discharge allows positive and negative electric charges to be generated within a discharge space. The positive electric charges are stacked on the scan electrode Yn. A majority of negative electric charges are stacked on the address electrode X and the sustain electrode Z while a portion of negative space electric charges are moved into the lower non-effective display area 33. At this time, if a positive voltage is applied to the lower dummy electrodes LD, then negative electric charges moved into the lower non-effective display area 33 are stacked on the lower dummy electrodes LD. As a result, since negative wall charges s are stacked on the lower dummy electrode LD and the uppermost scan electrode Yn of the effective display area 31, an abnormal discharge is not generated between the two electrodes LD and Yn.

Figure 7:
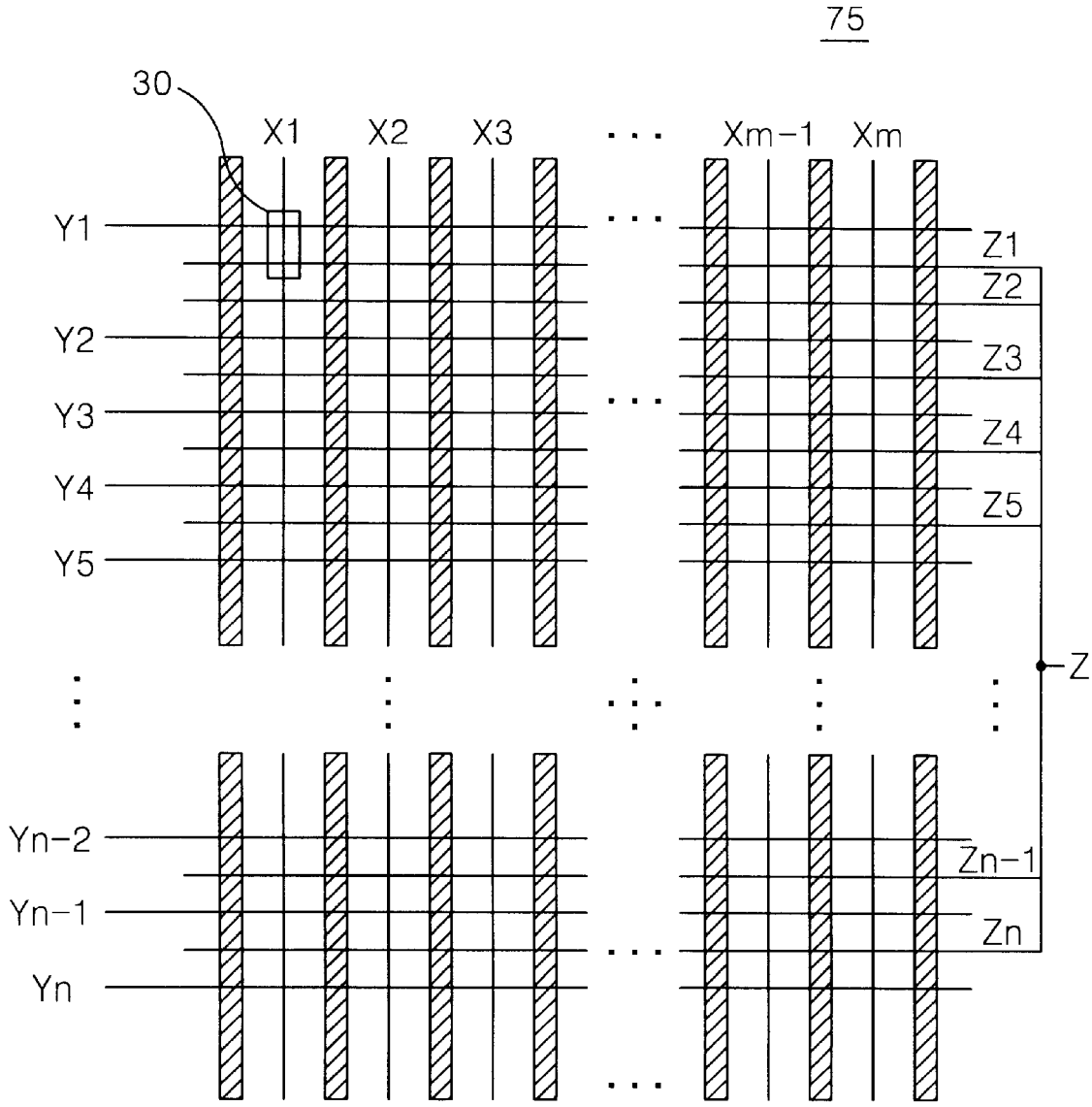
FIG. 7 is a plan view showing a schematic electrode arrangement of a plasma display panel according to a second embodiment of the present invention.

Referring now to FIG. 7, there is shown a PDP according to a second embodiment of the present invention.

In the PDP 75, dummy electrodes are eliminated and scan electrodes Y1 and Yn is arranged at the uppermost portion and the lowermost portion thereof, respectively. Two sustain electrodes Z are adjacent to each other at at least one portion of the PDP 75 such that the scan electrodes Y1 and Yn are arranged at all of the uppermost and the lowermost portions. In this embodiment, the first scan electrode Y1 is arranged at the uppermost portion, and two sustain electrodes Z1 and Z2 are adjacent to each other under the uppermost portion. The remaining scan electrodes Y2 to Yn and the sustain electrodes Z3 to Zn are alternately arranged.

A driving apparatus for driving the PDP 75 is substantially identical to a circuit in which only the dummy electrode driver 41 is eliminated from the driving apparatus for the PDP shown in FIG. 4. The PDP 75 shown in FIG. 7 divides one frame into a reset period for initializing the entire field, an address period for selecting the cell by an address discharge and a sustain period for causing a sustain discharge of the selected cell for its driving by such a driving apparatus. A principle of restraining an abnormal discharge in the PDP 75 shown in FIG. 7 will be described in conjunction with FIG. 8A and FIG. 8B.

Figure 1:
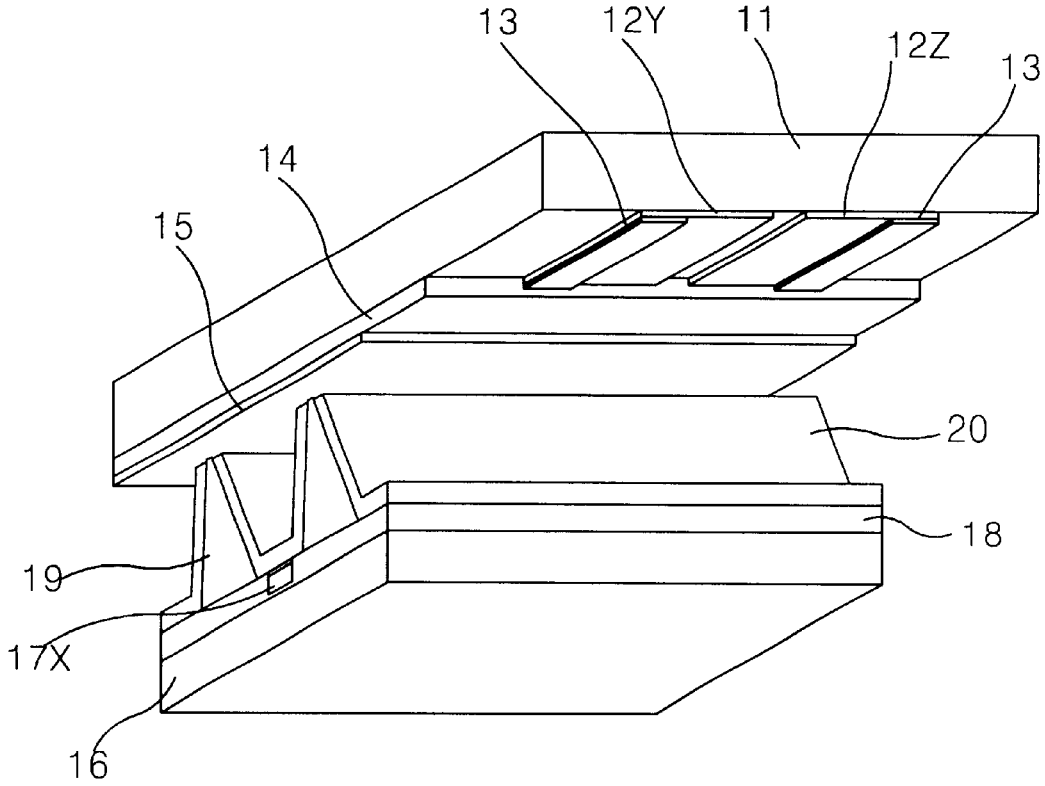
FIG. 1 CONVENTIONAL ART
FIG. 1 is a perspective view showing a discharge cell structure of a conventional three-electrode, AC surface-discharge plasma display panel.
Figure 2:
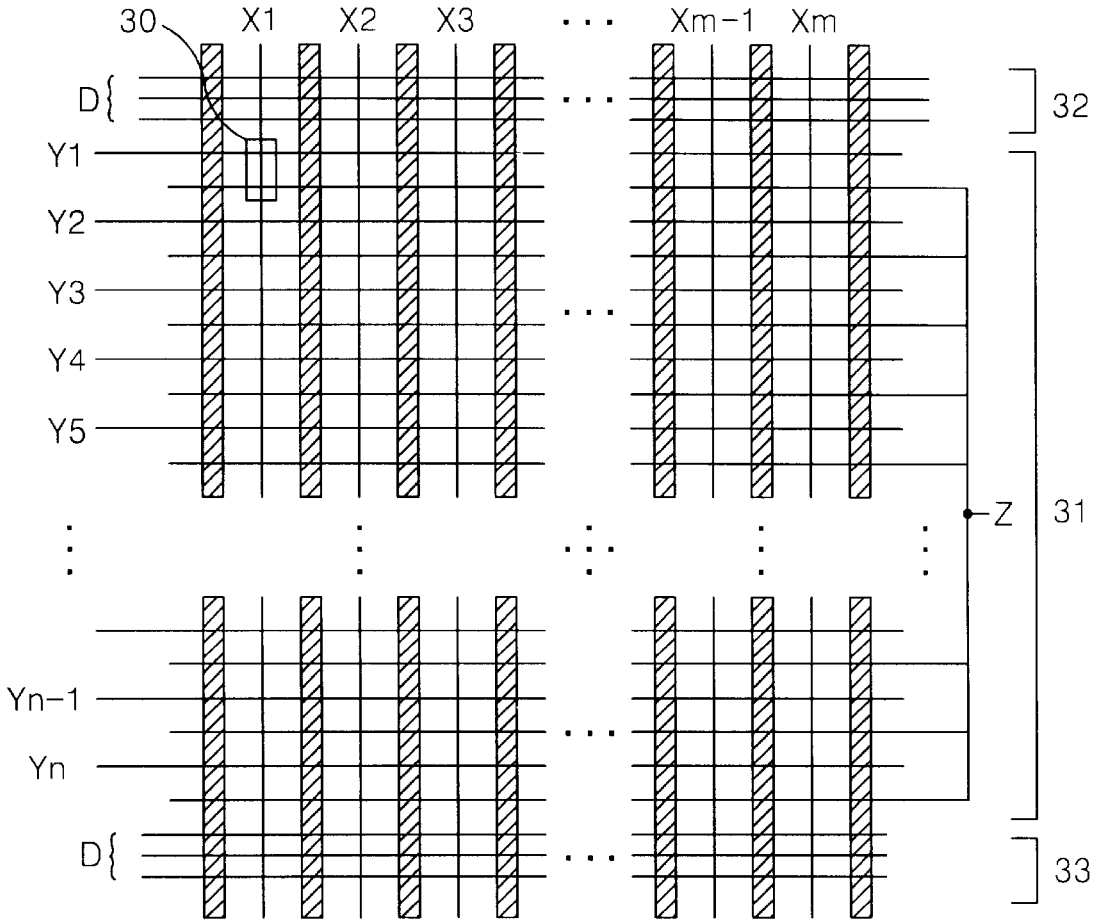
FIG.2 CONVENTIONAL ART
FIG. 2 is a plan view showing a schematic electrode arrangement of the plasma display panel of FIG. 1.
Figure 3:
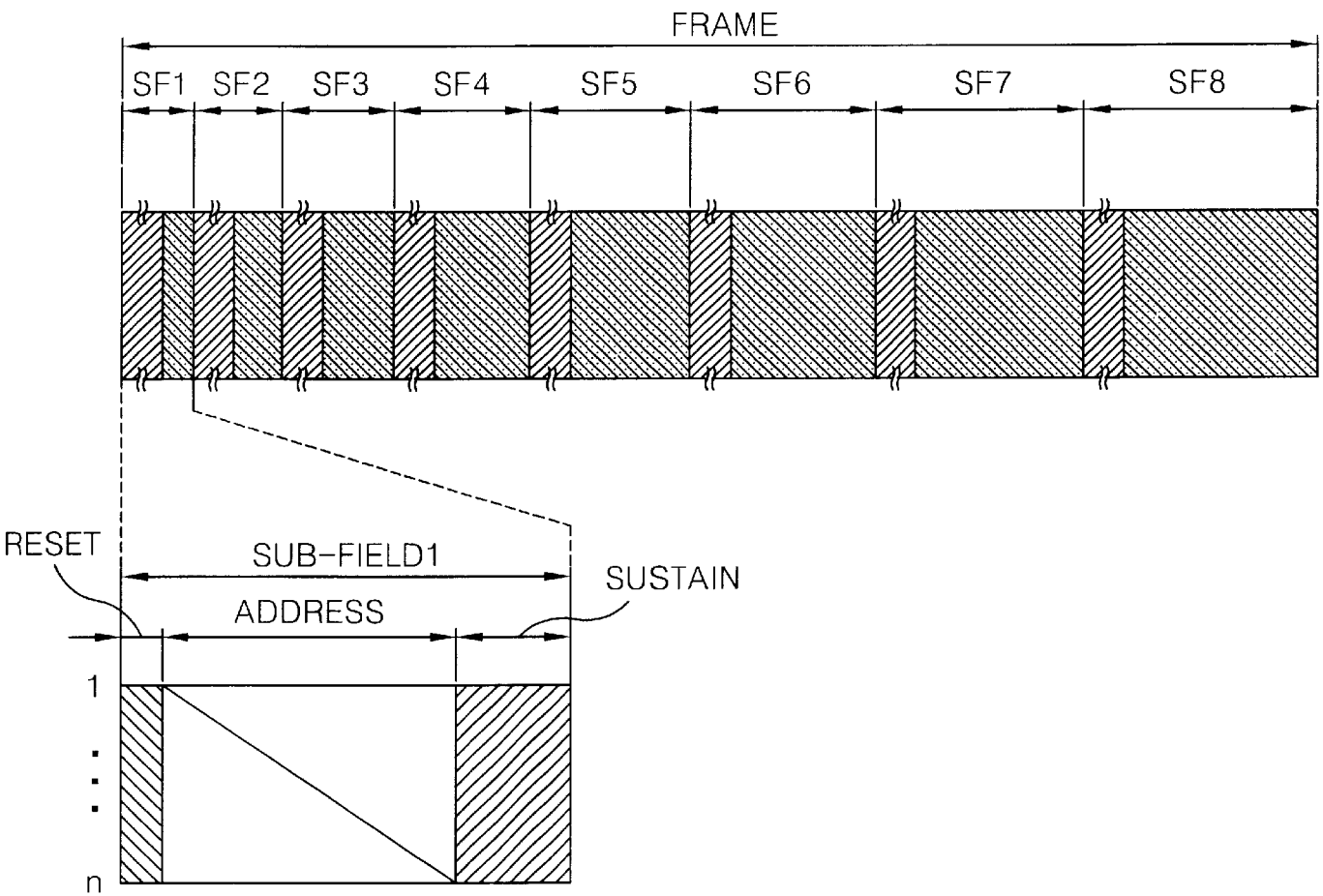
FIG.3 CONVENTIONAL ART
FIG. 3 depicts one frame interval divided into a plurality of sub-fields.
Figure 8A:
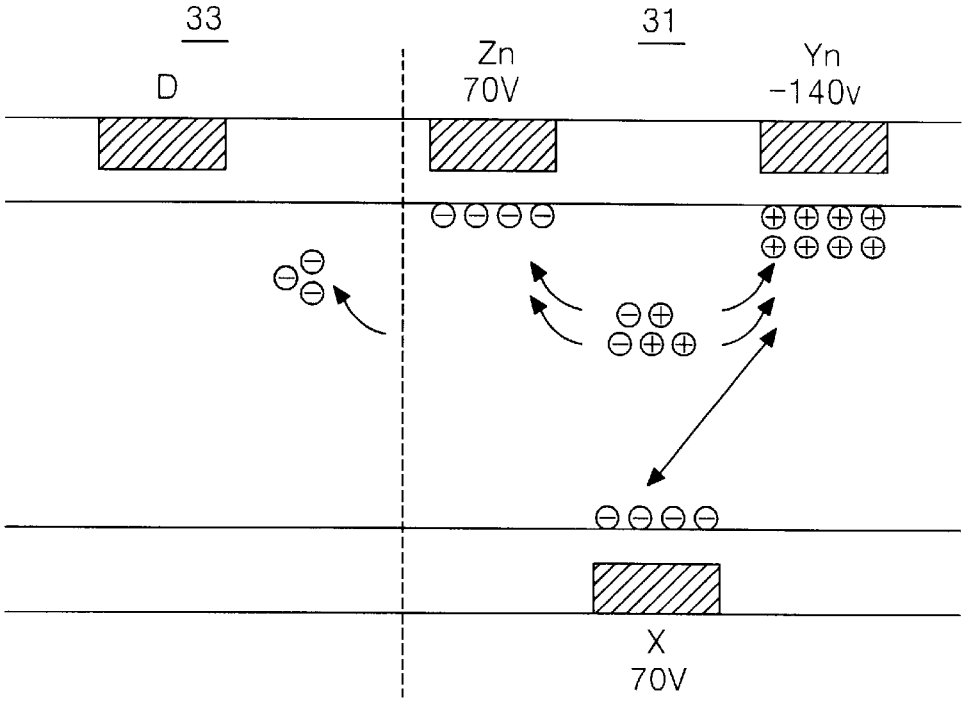
FIG. 8A depicts a movement of charged particles at a boundary portion between an upper non-effective display area and an effective display area of the conventional plasma display panel shown in FIG. 2.

In the conventional PDP shown in FIG. 2, if a negative scan voltage of about −140V is applied to the scan electrode Yn arranged at the lowermost line of the effective display area 31 being adjacent to the lower non-effective display area 33 and, at the same time, a positive data voltage of about 70V is applied to the address electrode X, then an address discharge occurs as shown in FIG. 8A. This address discharge allows positive and negative electric charges to be generated within a discharge space. The positive electric charges are stacked on the scan electrode Yn. A majority of negative electric charges are stacked on the address electrode X and the sustain electrode Zn while a portion of negative space electric charges are moved into the lower non-effective display area 33. At this time, if a quantity of charged particles accumulated on the lower non-effective display area 33 becomes excessively large, then an abnormal discharge occurs.

Figure 8B:
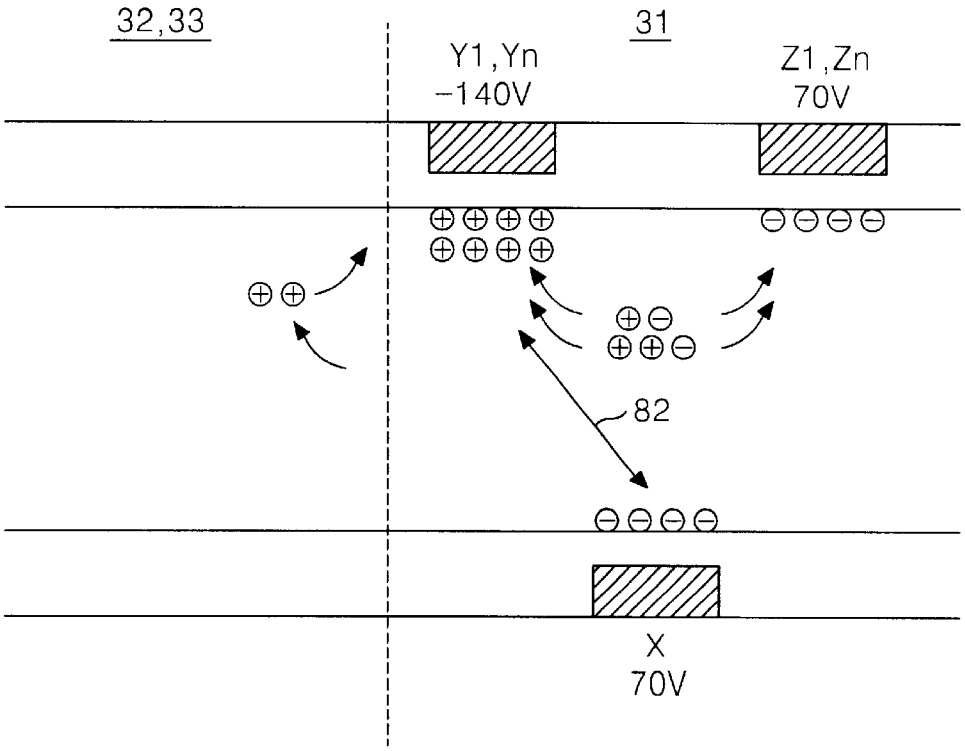
FIG. 8B depicts a movement of charged particles at a boundary portion between an upper non-effective display area and an effective display area of the plasma display panel shown in FIG. 2.

On the other hand, in the PDP 75 shown in FIG. 7, if a negative scan voltage of about −140V is applied to each of the uppermost and lowermost scan electrodes Y1 and Yn and, at the same time, a positive data voltage of about 70V is applied to the address electrode X to cause an address discharge, then electric charges moved into the non-effective display areas 32 and 33 is utilized for the address discharge because an address discharge path 82 is adjacent to the non-effective display areas 32 and 33 as shown in FIG. 8B. This can more lower an address discharge voltage and prevent an excessive amount of electric charges from being stacked on the non-effective display areas 32 and 33, so that it becomes possible to prevent an abnormal discharge.

Figure 9:
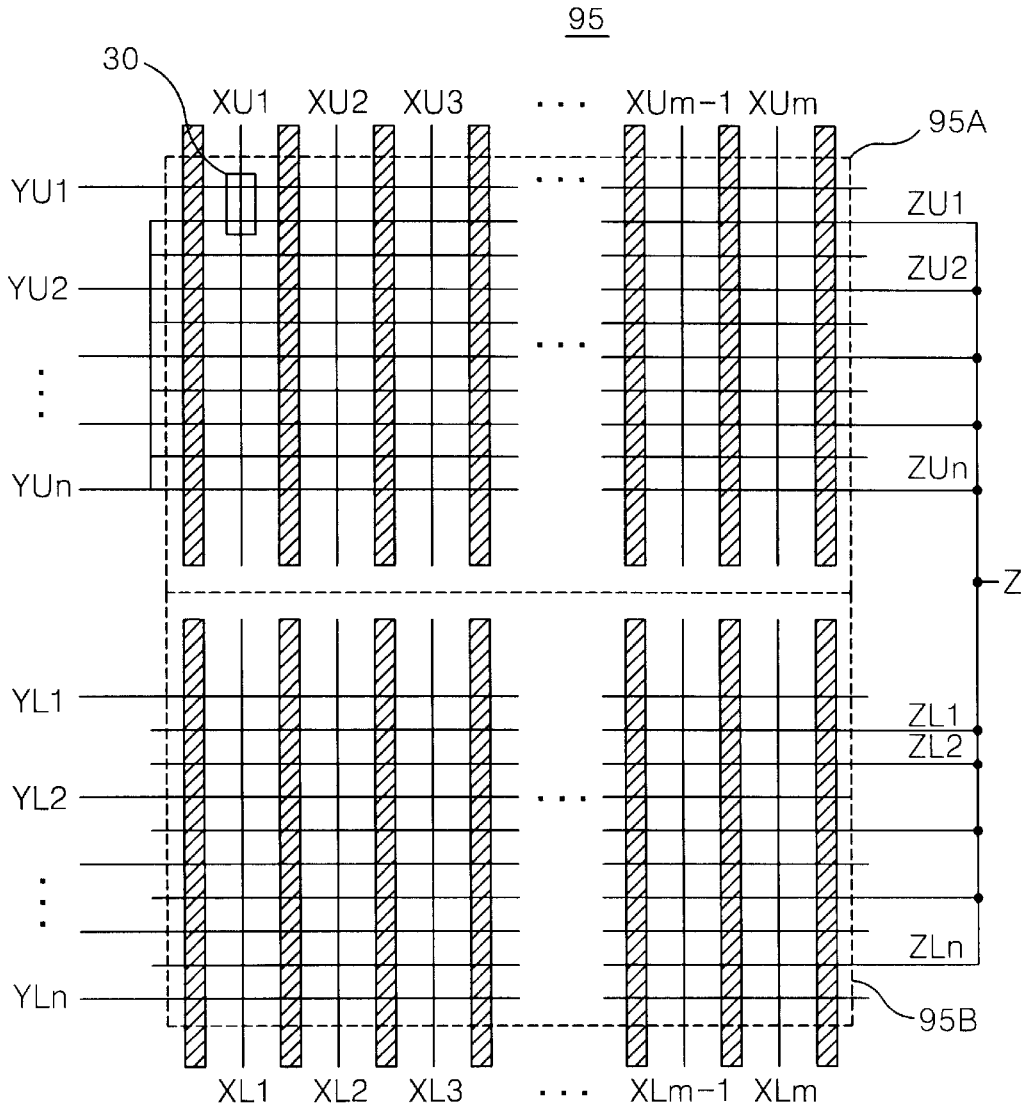
FIG. 9 is a plan view showing a schematic electrode arrangement of a plasma display panel according to a third embodiment of the present invention.

Referring to FIG. 9, there is shown a PDP according to a third embodiment of the present invention.

In the PDP 95, a two-divisional driving for the upper-half block 95A and the lower-half block 95B is made, and the dummy electrodes are eliminated. Further, scan electrodes YUn and YL1 are adjacent to each other at the boundary between the blocks and scan electrodes YU1 and YLn are arranged at the uppermost portion and the lowermost portion thereof, respectively.

In the PDP 95, the upper-half block 95A and the lower-half block 95B are sequentially scanned at the same time, so that an address period can be reduced to less than ½ in comparison to the prior art. The address electrodes of the PDP 95 are opened at the boundaries between the blocks to be divided into address electrodes for supplying a data to the upper-half block 95A and address electrodes XL1 to XLn for supplying a data to the lower-half block 95B.

The scan electrodes YUn and YL1 being adjacent to the boundary between the blocks utilize electric charges stacked excessively at the boundary between the blocks for an address discharge to thereby prevent an abnormal discharge generated at the boundary portion between the blocks. Further, the scan electrodes YU1 and YLn arranged at the uppermost portion and the lowermost portion, respectively utilize wall charges stacked on the non-effective display area at the uppermost outside and the non-effective display area at the lowermost outside for an address discharge to thereby prevent an abnormal discharge at each of the uppermost and lowermost portions.

A driving apparatus for driving the PDP 95 is substantially identical to the driving apparatus for the PDP shown in FIG. 4 except that the dummy electrode driver is eliminated and an address driver is divided to independently drive the address electrodes XU1 to XUm of the upper-half block 95A and the address electrode XL1 to XLm of the lower-half block 95B. The PDP 95 shown in FIG. 9 divides one frame into a reset period for initializing the entire field, an address period for selecting the cell by an address discharge and a sustain period for causing a sustain discharge of the selected cell for its driving by such a driving apparatus.

Figure 10:
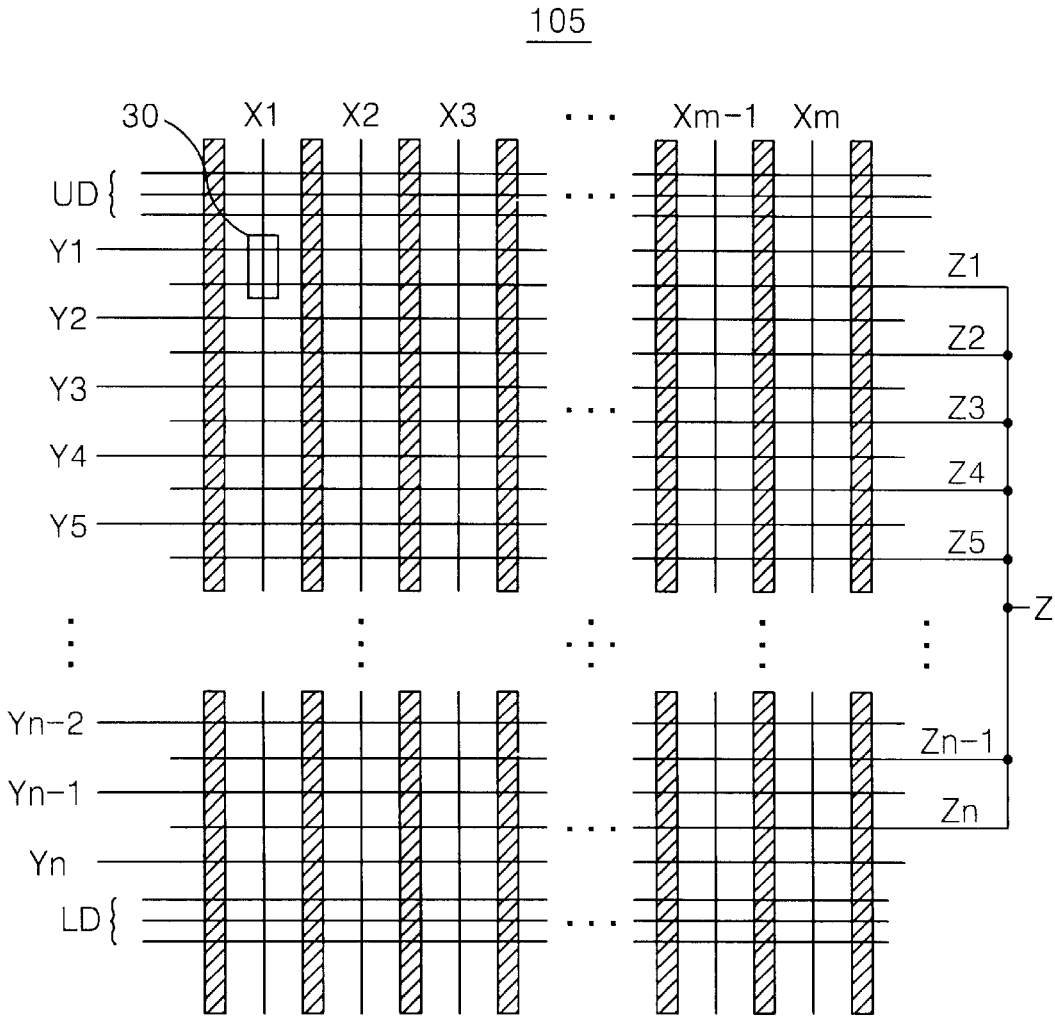
FIG. 10 is a plan view showing a schematic electrode arrangement of a plasma display panel according to a fourth embodiment of the present invention.

Referring to FIG. 10, there is shown a PDP according to a fourth embodiment of the present invention.

In the PDP 105, dummy electrodes UD and LD are provided at a non-effective display area positioned at the upper and lower outsides of an effective display area, and scan electrodes Y1 and Yn are arranged at the uppermost and lowermost portions of the effective display area, respectively. This electrode arrangement allows the scan electrodes Y1 to Yn arranged at the uppermost and lowermost portion of the effective display area, respectively, to be adjacent to the dummy electrodes UD and LD at the non-effective display area.

A negative voltage (e.g., approximately more than −70V) from a dummy electrode driver (not shown) is applied to the dummy electrodes UD and LD during the address period. The dummy electrodes UD and LD plays a role to confine electric charges having been moved from the effective display area into the non-effective display area during the address period, thereby restraining an abnormal discharge generated at the non-effective display area or at the boundary portion between the non-effective display area and the display area.

A driving apparatus for driving the PDP 105 is substantially identical to the driving apparatus for the PDP shown in FIG. 4 except that the dummy electrode driver 41 applies a negative voltage to all of the upper dummy electrodes UD and the lower dummy electrodes LD in the address period. The PDP 105 shown in FIG. 10 divides one frame into a reset period for initializing the entire field, an address period for selecting the cell by an address discharge and a sustain period for causing a sustain discharge of the selected cell for its driving by such a driving apparatus.

Figure 11:
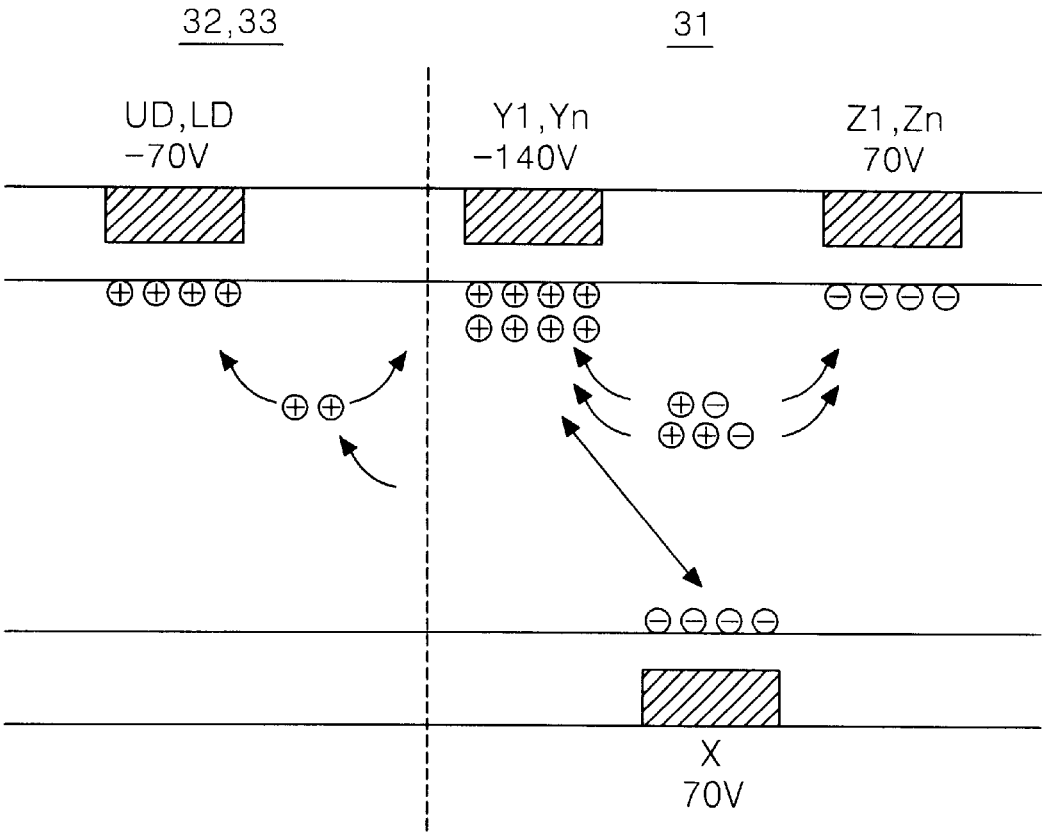
FIG. 11 depicts a movement of charged particles at a boundary portion between an upper non-effective display area and an effective display area of the plasma display panel shown in FIG. 10.

FIG. 11 shows a movement of electric charges when an address discharge is generated at the uppermost and lowermost portion of the PDP 105 shown in FIG. 10.

Referring to FIG. 11, the dummy electrodes UD and LD provided at the non-effective display areas 32 and 33 are adjacent to the uppermost or lowermost scan electrode Y1 or Yn of the effective display area 31.

If a negative scan voltage of about −140V is applied to the uppermost or lowermost scan electrode Y1 or Yn and, at the same time, a positive data voltage of about 70V is applied to the address electrode X, an address discharge occurs. This address discharge allows positive and negative electric charges to be generated within a discharge space. Further, a majority of positive electric charges are stacked on the scan electrode Y1, and a portion of positive space electric charges are moved into the non-effective display areas 32 and 33. At this time, if a negative voltage is applied to the dummy electrodes UD and LD, then positive electric charges moved into the non-effective display areas 32 and 33 are stacked on the upper dummy electrodes UD and LD. As a result, positive wall charges are stacked on the dummy electrodes UD and LD is and the scan electrodes Y1 and Yn of the effective display area 31, so that it becomes possible to prevent an abnormal discharge from being generated between the two electrodes UD and Y1.

As described above, according to the present invention, a voltage having the same polarity as a voltage applied the uppermost or lowermost electrode of the display area is applied to the dummy electrodes. Otherwise, the dummy electrodes are eliminated and the scan electrode is provided at each of the uppermost and lowermost portion of the PDP. When the PDP is divided into the upper-half block and the lower-half block, all of the two electrodes being adjacent to the boundary between the blocks and the electrodes positioned at the uppermost and lowermost portion are set to the scan electrodes. Accordingly, it becomes possible to prevent an abnormal discharge that may be generated the upper and lower edges of the effective display area. Furthermore, it becomes possible to prevent an abnormal discharge that may be generated at the boundary between the blocks when the PDP is divisionally driven.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a plasma display panel, comprising the steps of:

applying a voltage with potential difference enabling discharge to two electrodes opposed to each other with having a space discharge therebetween within an effective display area to select a cell; and applying a constant voltage to a dummy electrode arranged at the outside of the effective display area during an address period for selecting said cell.

2. The method as claimed in claim 1, wherein said voltage applied to the dummy electrode is a positive voltage.

3. The method as claimed in claim 1, wherein said voltage applied to the dummy electrode is a negative voltage.

4. The method as claimed in claim 1, further comprising the step of:

applying a reset voltage to a scan electrode, which is any one of said two electrodes, prior to selecting said cell to initialize cells of the entire field.

5. The method as claimed in claim 4, further comprising the step of:

synchronizing a voltage having the same polarity as the reset voltage and a lower voltage level than the reset voltage to apply it to an address electrode of said two electrodes.

6. A method of driving a plasma display panel, comprising the steps of:

arranging a scan electrode supplied with a scan voltage at the uppermost and lowermost portion of an effective display area and applying a voltage with potential difference enabling discharge to an address electrode crossing the scan electrode and said scan electrode, thereby selecting a cell; and alternately applying a sustain voltage to a sustain electrode making a pair with the scan electrode and said scan electrode to cause a sustain discharge for the selected cell.

7. The method as claimed in claim 6, wherein said sustain electrode is arranged successively at least one portion thereof.

8. The method as claimed in claim 6, further comprising the step of:

arranging a dummy electrode within a non-effective display area being adjacent to the scan electrodes at the uppermost and lowermost portions thereof.

9. The method as claimed in claim 8, wherein said voltage applied to the dummy electrode is a negative voltage.

10. The method as claimed in claim 6, wherein said address electrodes are divided and said scan electrodes are arranged in such a manner to be adjacent to each other at the divided areas.

11. A driving apparatus for a plasma display panel, comprising:

a driver for applying a voltage with potential difference enabling discharge to two electrodes opposed to each other with having a space discharge therebetween within an effective display area to select a cell between the two electrodes; and a dummy electrode driver for applying a constant voltage to a dummy electrode arranged at the outside of the effective display area during an address period for selecting said cell.

12. The driving apparatus as claimed in claim 11, wherein the dummy electrode driver applies a positive voltage to the dummy electrode.

13. The driving apparatus as claimed in claim 11, wherein the dummy electrode driver applies a negative voltage to the dummy electrode.

14. The driving apparatus as claimed in claim 11, wherein said driver includes:

a scan driver for applying a reset voltage, a scan voltage and a sustain voltage to the scan electrode; and an address driver for applying a data voltage synchronized with said scan voltage to the address electrode opposed to the scan electrode with having a discharge space therebetween.

15. The driving apparatus as claimed in claim 14, wherein the address driver synchronizes a voltage having the same polarity as said reset voltage and a lower voltage level than said reset voltage with said reset voltage to apply it to the address electrode.

16. The driving apparatus as claimed in claim 14, further comprising:

a sustain driver for applying a sustain voltage to a sustain electrode making a pair with the scan electrode.

17. A driving apparatus for a plasma display panel, comprising:

a first driver for applying a voltage with potential difference enabling discharge to scan electrodes arranged at the uppermost and lowermost portions of an effective display area and an address electrode crossing the scan electrodes to select a cell; and a second driver for alternately applying a sustain voltage to a sustain electrode making a pair with the scan electrode and said scan electrode to cause a sustain discharge for the selected cell.

18. The driving apparatus as claimed in claim 17, wherein said sustain electrode is arranged successively at least one portion thereof.

19. The driving apparatus as claimed in claim 17, further comprising:

a dummy electrode arranged within a non-effective display area being adjacent to the scan electrodes at the uppermost and lowermost portions thereof.

20. The driving apparatus as claimed in claim 19, further comprising:

a dummy driver for applying a negative voltage to the dummy electrode.

21. The driving apparatus as claimed in claim 17, wherein said address electrodes are divided and said scan electrodes are arranged in such a manner to be adjacent to each other at the divided areas.

* * * * *